US008605126B2

(12) United States Patent
Kang et al.

(10) Patent No.: US 8,605,126 B2
(45) Date of Patent: Dec. 10, 2013

(54) DISPLAY APPARATUS

(75) Inventors: Shin Tack Kang, Yongin-si (KR); Gyutae Kim, Seoul (KR); Eon-Young Kim, Asan-si (KR); HyeonHwan Kim, Asan-si (KR); Sungman Kim, Seoul (KR)

(73) Assignee: Samsung Display Co., Ltd., Yongin (KR)

( * ) Notice: Subject to any disclaimer, the term of this patent is extended or adjusted under 35 U.S.C. 154(b) by 190 days.

(21) Appl. No.: 13/276,659

(22) Filed: Oct. 19, 2011

(65) Prior Publication Data

US 2012/0206437 A1 Aug. 16, 2012

(30) Foreign Application Priority Data

Feb. 15, 2011 (KR) ..... 10-2011-0013361

(51) Int. Cl.
*G09G 5/10* (2006.01)

(52) U.S. Cl.
USPC ..... 345/690; 345/55; 345/87

(58) Field of Classification Search
USPC ..... 345/690, 89, 55, 84, 87, 98, 100
See application file for complete search history.

(56) References Cited

U.S. PATENT DOCUMENTS

| | | | | |
|---|---|---|---|---|
| 6,707,441 | B1 * | 3/2004 | Hebiguchi et al. | 345/92 |
| 8,253,670 | B2 * | 8/2012 | Ono | 345/87 |
| 8,462,092 | B2 * | 6/2013 | Hsu et al. | 345/96 |
| 2003/0227433 | A1 * | 12/2003 | Moon | 345/100 |
| 2005/0243044 | A1 * | 11/2005 | Kang et al. | 345/87 |
| 2006/0081850 | A1 * | 4/2006 | Lee et al. | 257/72 |
| 2009/0051641 | A1 * | 2/2009 | Irie et al. | 345/96 |
| 2009/0195495 | A1 * | 8/2009 | Hsu et al. | 345/104 |
| 2010/0156954 | A1 * | 6/2010 | Kim et al. | 345/690 |
| 2010/0157190 | A1 * | 6/2010 | Lee et al. | 349/54 |
| 2010/0188437 | A1 * | 7/2010 | Itoh et al. | 345/690 |

* cited by examiner

*Primary Examiner* — Koosha Sharifi-Tafreshi
(74) *Attorney, Agent, or Firm* — H.C. Park & Associates, PLC

(57) ABSTRACT

A display apparatus includes a substrate, gate lines disposed on the substrate, data lines extending across the gate lines, and pixels connected to the gate lines and the data lines. The pixels arranged in a matrix of rows and columns. The pixels disposed in the same columns are alternately connected to data lines disposed to the left or right sides of the column. The pixels may be disposed in different display areas of the substrate. Adjacent pixels in the same columns but in different display areas may be connected to the same data line.

17 Claims, 18 Drawing Sheets

DISPLAY APPARATUS

CROSS-REFERENCE TO RELATED APPLICATION

This application claims priority from and the benefit of Korean Patent Application No. 10-2011-0013361 filed on Feb. 15, 2011, which is hereby incorporated by reference for all purposes as if fully set forth herein.

BACKGROUND

1. Field of the Disclosure

Exemplary embodiments of the present invention relate to a display apparatus having improved display qualities.

2. Discussion of the Background

In general, a liquid crystal display includes a first substrate on which a pixel electrode is arranged, a second substrate on which a common electrode is arranged, and a liquid crystal layer disposed between the first and second substrates. The liquid crystal display controls the transmittance of light through the liquid crystal layer, by generating an electric field between the pixel electrode and the common electrode, to display an image.

In order to prevent an electric charge from being accumulated in the pixel electrode and to easily control a voltage applied to the pixel electrode, voltages having different polarities from each other, with respect to a voltage applied to the common electrode, are alternately applied to the pixel electrode. However, the voltage charged in the pixel electrode is varied by the voltage variation on signal lines, through which the voltage for the pixel electrode is transmitted.

SUMMARY

Exemplary embodiments of the present invention provide a display apparatus having improved display qualities.

Additional features of the invention will be set forth in the description which follows, and in part will be apparent from the description, or may be learned by practice of the invention.

According to various embodiments, a display apparatus includes a substrate including a display area, a plurality of gate lines, a plurality of data lines, and a plurality of pixels. The gate lines extend in a row direction on the substrate. The data lines extend in a column direction while being insulated from the gate lines. The pixels are arranged in the display area and connected to the gate lines and the data lines.

Among the pixels, the pixels arranged in the same column are alternately connected to a left-side data line or a right-side data line arranged in the same column. In addition, when the display area is divided into n (n is a constant number equal to or larger than 2) display areas in the column direction, two adjacent pixels arranged in the same column and disposed in different display areas are connected to the same data line.

According to the above, the voltage charged in each pixel may be uniformly adjustable, by using voltages applied to the data lines, without relating to the position of the pixels in the display area of the display apparatus. Thus, display quality reduction caused by parasitic capacitance generated between the pixels and the data lines may be prevented, thereby providing improved display qualities.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION

Figure 1:
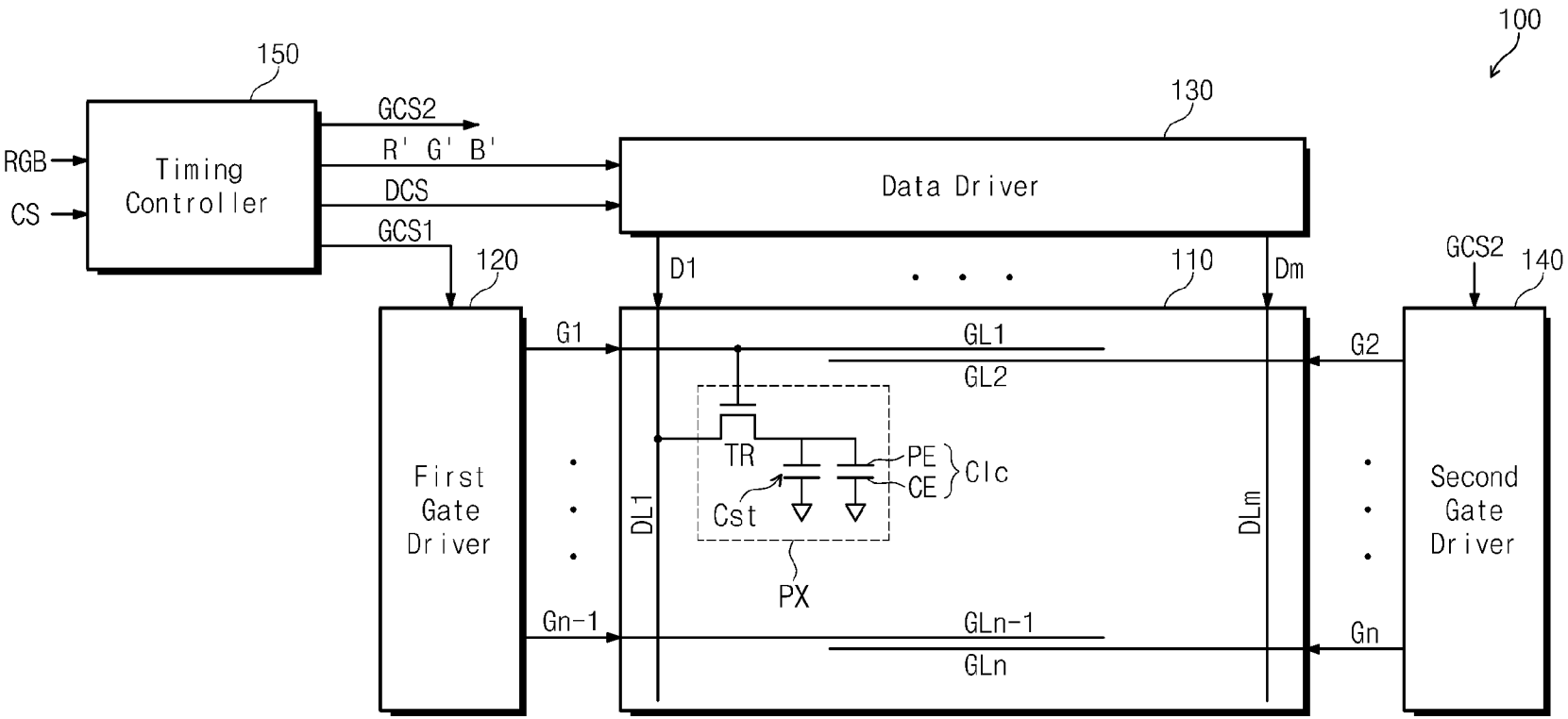
FIG. 1 is a block diagram showing a display apparatus, according to an exemplary embodiment of the present invention.

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these exemplary embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, exemplary embodiments the present invention will be explained in detail with reference to the accompanying drawings. FIG. 1 is a block diagram showing a display apparatus 100, according to an exemplary embodiment of the present invention. Referring to FIG. 1, the display apparatus 100 includes a display panel 100, a first gate driver 120, a second gate driver 140, a data driver 130, and a timing controller 150.

The timing controller 150 receives image signals RGB and a control signal CS from outside of the display apparatus 100. The timing controller 150 converts a data format of the image signals RGB into a data format appropriate to interface with the data driver 130 and the timing controller 150. The timing controller 150 provides the converted image signals R'G'B' to the data driver 130. In addition, the timing controller 150 applies a data control signal DCS, such as an output start signal, a horizontal start signal, a polarity inversion signal, etc., to the data driver 130.

The timing controller 150 applies a first gate control signal GCS1, such as a first clock signal, a second clock signal, a start signal, an off voltage, etc., to the first gate driver 120. The timing controller 150 applies a second gate control signal GCS2 to the second gate driver 140. The first and second gate drivers 120 and 140 sequentially output gate signals G1 to Gn, in response to the first and second gate control signals GCS1 and GCS2.

The data driver 130 converts the image signals R'G'B' into data voltages D1 to Dm, in response to the data control signal DCS from the timing controller 150. The data driver 130 outputs the data voltages D1 to Dm. The data voltages D1 to Dm are applied to the display panel 110. The display panel 110 includes a plurality of gate lines GL1 to GLn, a plurality of data lines DL1 to DLm crossing the gate lines GL1 to GLn, and a plurality of pixels PX.

In the present exemplary embodiment, the pixels PX have the same structure and function. Thus, one pixel is described in FIG. 1 as a representative example. Each of the pixels PX includes a thin film transistor TR, a liquid crystal capacitor Clc, and a storage capacitor Cst. The thin film transistor TR includes a gate electrode connected to a corresponding one of the gate lines GL1 to GLn, a source electrode connected to a corresponding one of the data lines DL1 to DLm, and a drain electrode connected to a pixel electrode PE and the storage capacitor Cst.

The odd-numbered gate lines GL1, GL3, . . . , GLn−1 are connected to the first gate driver 120. The even-numbered gate lines GL2, GL4, . . . , GLn are connected to the second gate driver 140. The data lines DL1 to DLm are connected to the data driver 130. The gate lines GL1 to GLn are supplied with the gate signals G1 to Gn by the first and second gate drivers 120 and 140. The data lines DL1 to DLm are supplied with the data voltages D1 to Dm by the data driver 130.

The thin film transistor TR in each pixel PX is turned on in response to the gate signal supplied through the corresponding gate line, the data voltage supplied to the corresponding data line is supplied to the corresponding pixel electrode PE through the turned-on thin film transistor. Meanwhile, a common voltage is supplied to a common electrode CE that forms an electric field together with the pixel electrode PX.

The electric field formed between the pixel electrode PE and the common electrode CE corresponds to an electric potential difference between the common voltage and the data voltage. Each pixel PX may control the transmittance of light therethrough, according to the electric field formed between the pixel electrode and the common electrode, thereby displaying an image.

Although not shown in FIG. 1, the display apparatus 100 may further include a backlight unit that is positioned adjacent to the display panel 100 to provide the light to the display panel 100. The backlight unit includes a plurality of light sources, such as a light emitting diode (LED), a cold cathode fluorescent lamp (CCFL), etc.

Figure 2A:
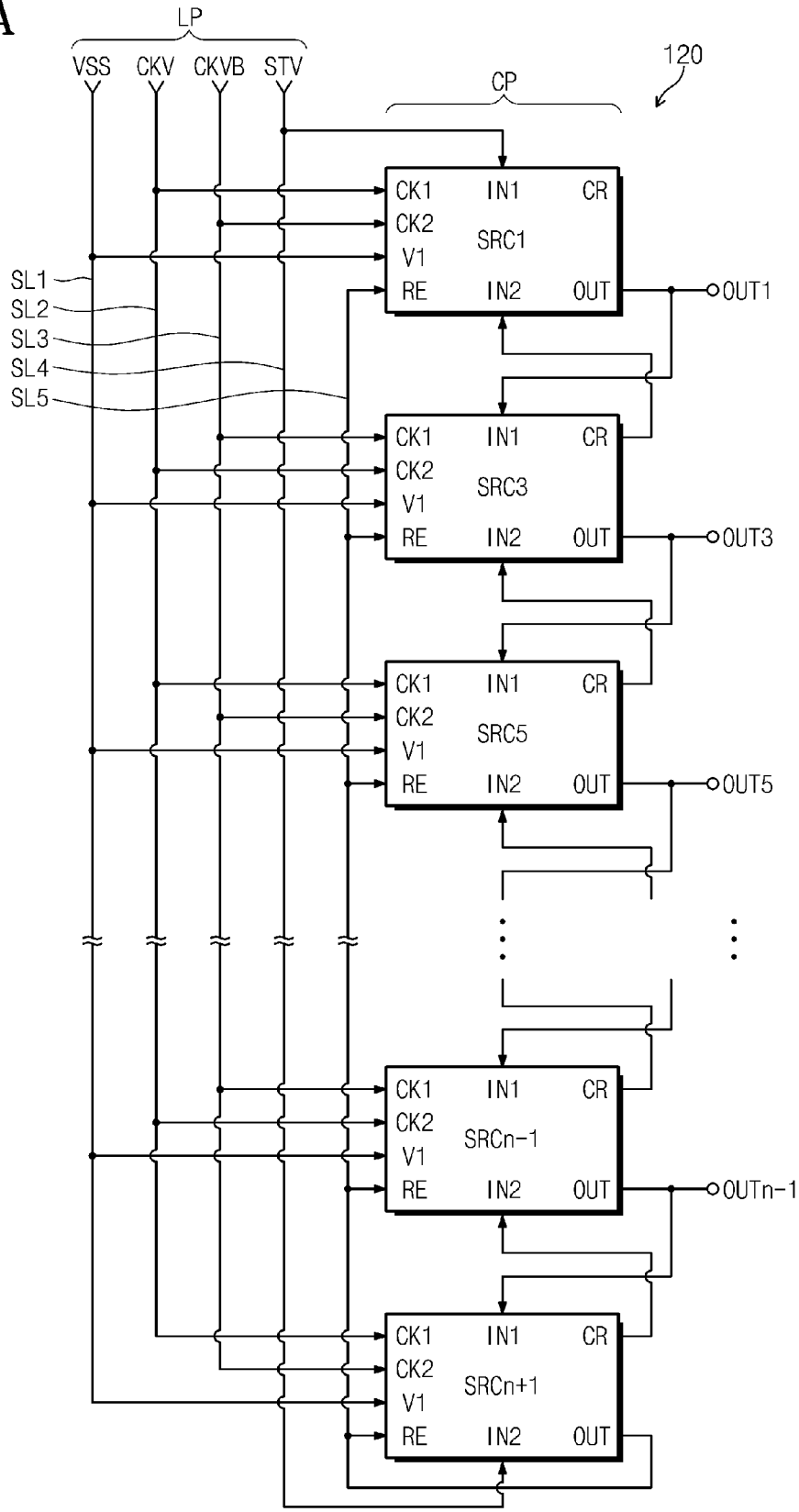
FIG. 2A is a block diagram showing a gate driver shown in FIG. 1.

FIG. 2A is a block diagram showing a gate driver shown in FIG. 1. Referring to FIG. 2A, the first gate driver 120 includes a circuit part CP and a line part LP disposed adjacent to the circuit part CP.

The circuit part CP includes first to (n+1)th stages SRC1, SRC3, . . . , SRCn−1, and SRCn+1 that are sequentially connected to each other. The first to (n−1)th stages SRC1, SRC3, . . . , and SRCn−1 sequentially output first to (n−1)th gate signals to first to (n−1)th output terminals OUT1, OUT3, . . . , and OUTn−1. In detail, the first to (n−1)th output terminals OUT1, OUT3, . . . , and OUTn−1 are connected to the odd-numbered gate lines GL1, GL3, . . . , and GLn−1, to provide the first to (n−1)th gate signals to the odd-numbered gate lines GL1, GL3, . . . , and GLn−1.

Each of the first to (n+1)th stages SRC1, SRC3, . . . , SRCn−1, and SRCn+1 includes a first clock terminal CK1, a second clock terminal CK2, a first input terminal IN1, a second input terminal IN2, an off voltage terminal V1, a reset terminal RE, a carry terminal CR, and an output terminal OUT.

The first clock terminals CK1 of the odd-numbered stages SRC1, SRC5, . . . , and SRCn+1 are supplied with a first clock signal CKV. The first clock terminals CK1 of the even-numbered stages SRC3, . . . , and SRCn−1 are supplied with a second clock signal CKVB having a different phase from the first clock signal CKV. Meanwhile, the second clock terminal CK2 of the odd-numbered stages SRC1, SRC5, . . . , and SRCn+1 is supplied with the second clock signal CKVB, and the second clock terminal CK2 of the even-numbered stages SRC31, . . . , and SRCn−1 is supplied with the first clock signal CKV.

The first input terminal IN1 of each of the first to (n+1)th stages SRC1, SRC3, . . . , SRCn−1, and SRCn+1 is supplied with a start signal STV or a gate signal from a previous stage. The second input terminal IN2 of each of the first to (n+1)th stages SRC1, SRC3, . . . , SRCn−1, and SRCn+1 is supplied with a carry signal from a subsequent stage. The (n+1)th stage SRCn+1 is a dummy stage to apply the carry signal to the second input terminal IN2 of the (n−1)th stage SRCn−1. Since there is no stage after the (n+1)th stage SRCn+1, the second input terminal IN2 of the (n+1)th stage SRCn+1 is supplied with the start signal STV instead of the carry signal.

The off voltage terminal V1 of each of the first to (n+1)th stages SRC1, SRC3, . . . , SRCn−1, and SRCn+1 is supplied with an off voltage VSS. The reset terminal RE of each of the first to (n+1)th stages SRC1, SRC3, . . . , SRCn−1, and SRCn+1 is supplied with a reset signal output from the (n+1) th stage SRCn+1.

The first clock signal CKV is output from the carry terminal CR and the output terminal of every other one of the stages SRC1, SRC5, . . . , and SRCn+1, and the second clock signal CKVB is output from the carry terminal CR and the output terminal of the remaining stages SRC3, . . . , and SRCn−1. The carry signal output from the carry terminal CR of each of the stages SRC3, . . . , and SRCn−1 is applied to the second input terminal IN2 of the previous stage. In addition, each of the first to (n−1)th gate signals output from the output terminal OUT of each of the first to (n−1)th stages SRC1, SRC3, . . . , SRCn−1 is applied to the first input terminal IN1 of the next stage.

The line part LP includes first, second, third, fourth, and fifth signal lines SL1, SL2, SL3, SL4, and SL5. The first to fourth signal lines SL1 to SL4 respectively receive the off voltage VSS, the first clock signal CKV, the second clock signal CKVB, and the start signal STV from the timing controller 150 and provide the off voltage VSS, the first clock signal CKV, the second clock signal CKVB, and the start signal STV to the first to (n+1)th stages SRC1, SRC3, . . . , SRCn−1, and SRCn+1. The fifth signal line SL5 provides the reset signal output from the (n+1)th stage SRCn+1 to the reset terminal of each of the first to (n+1)th stages SRC1, SRC3, . . . , SRCn−1, and SRCn+1.

Although not shown in FIG. 2A, the second gate driver 140 has the same structure as the first gate driver 120, to apply the gate signals to even-numbered gate lines GL2, GL4, . . . , and GLn.

Figure 2B:
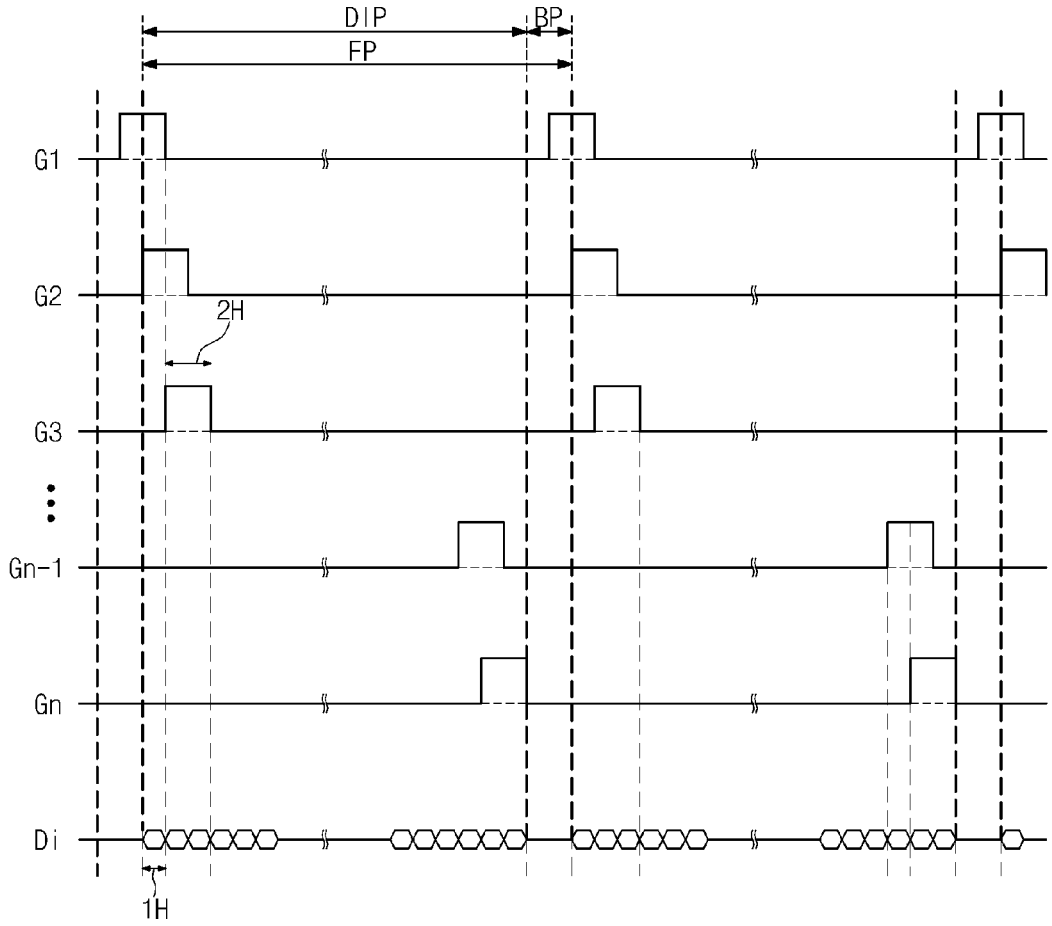
FIG. 2B is a timing diagram of signals applied to a display panel shown in FIG. 1.

FIG. 2B is a timing diagram of signals applied to a display panel shown in FIG. 1. FIG. 2B shows first to third, (n−1)th, and n-th gate signals of the gate signals G1 to Gn and i-th data signal Di, as representative examples. Referring to FIG. 2B, the gate signals G1 to Gn and the data signal Di are repeatedly applied over frame time period FP. The timing of the signals is shown during two frame time periods.

The frame time period FP includes a data input time period DIP and a blank time period BP. The data signal is applied to the data lines DL1 to DLm during the data input time period DIP, and FIG. 2B shows the i-th data signal Di applied to the i-th data line. The i-th data signal Di is sequentially applied to the pixels connected to the i-th data line, over a 1 H time period. During the blank time period BP, the display apparatus 100 prepares the data voltages for a next frame.

Each of the gate signals G1 to Gn has a high period, i.e., a gate-on signal, corresponding to a 2 H time period, during each frame. The high period of the gate signals G1 to Gn occurs for a 2 H time period (two 1 H time periods). Accordingly, the high periods of two adjacent gate signals overlap during the 1 H time period. When the high period of the first gate signal G1 is finished, the high period of the third gate signal G3 starts.

The first 1 H time period of the 2 H time period of each of the gate signals G1 to Gn is used for precharge driving, and the second 1 H time period of the 2 H time period of each of the gate signals G1 to Gn is a time period during which the data voltage is substantially input. In detail, the first 1 H time period of the 2 H time period of the second gate signal G2 overlaps with the second 1 H time period of the first gate signal G1. Thus, the data voltage is input to the pixels connected to the first gate line GL1, to which the first gate signal G1 is applied, and the pixels connected to the second gate line GL2, to which the second gate signal G2 is applied, is precharged to receive the next data voltage.

In FIG. 2B, the blank time period BP is longer than the 1 H time period. However, the present invention is not limited thereto. That is, the blank time period BP may be equal to or longer than the 1 H time period.

In FIG. 2B, the display apparatus 100 has been driven by a pre-charge driving method, in which the display apparatus 100 applies the gate-on signal to the next gate line when the gate-on signal is applied to the present gate line. However, the present invention is not to the pre-charge driving method. In addition, the first and second gate drivers 120 and 140 are shown as being mounted on the display panel 110, but are not limited to such a configuration.

Figure 3:
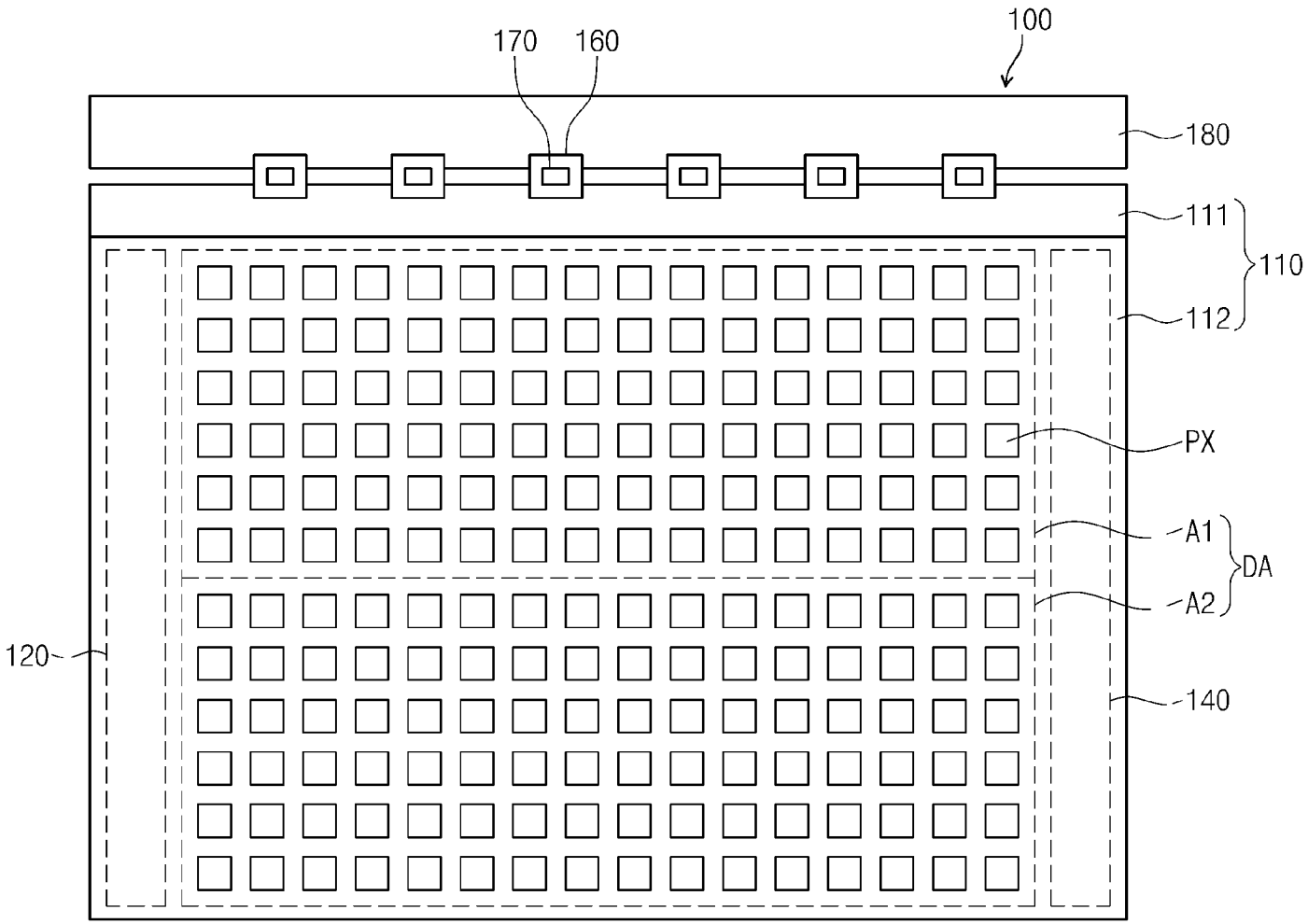
FIG. 3 is a plan view showing the display apparatus shown in FIG. 1, according to an exemplary embodiment of the present invention.

FIG. 3 is a plan view showing the display apparatus shown in FIG. 1, according to an exemplary embodiment of the present invention. Referring to FIG. 3, the display apparatus 100 further includes a printed circuit board 180 disposed adjacent to a side of the display panel 110, to output a driving signal.

The display panel 110 may include a first substrate 111, a second substrate 112 facing the first substrate 111, and a liquid crystal layer (not shown) disposed between the first substrate 111 and the second substrate 112. The printed circuit board 180 is connected to the display panel 110 through tape carrier packages (TCPs) 160. The tape carrier packages 160 include driving chips 170 respectively mounted thereon.

Although not shown in FIG. 3, each of the driving chips 170 may include the data driver 130 built therein. The first and second gate drivers 120 and 140 may be directly formed on the display panel 110, through a thin film process. In addition, the driving chips 170 may be mounted on the display panel 110 by a chip-on-glass (COG) method. In this case, the driving chips 170 may be integrated into one chip.

The gate lines GL1 to GLn, the data lines DL1 to DLm, and the pixels PX may be arranged on the first substrate 111, and the common electrode may be arranged on the second substrate 112. The pixels PX are arranged in a matrix in the display area DA of the display panel 110. FIG. 3 shows the pixels PX disposed in a matrix of twelve rows and sixteen columns, as an example.

The display area DA is divided into a first display area A1 corresponding to an upper portion of the display area DA and a second display area A2 corresponding to a lower portion of the display area DA. The arrangement of the pixels in the first and second display areas A1 and A2 will be described in detail with reference to the following drawings.

Figure 4A:
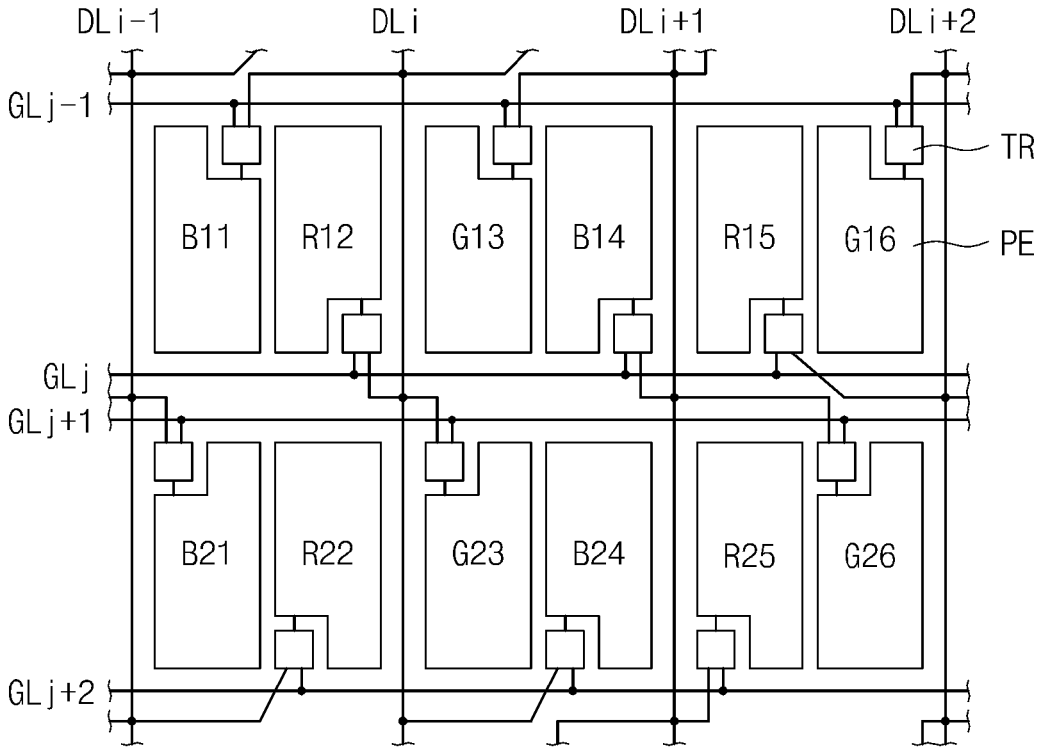
FIG. 4A is an enlarged plan view showing pixels arranged in a first display area of FIG. 3.
Figure 4B:
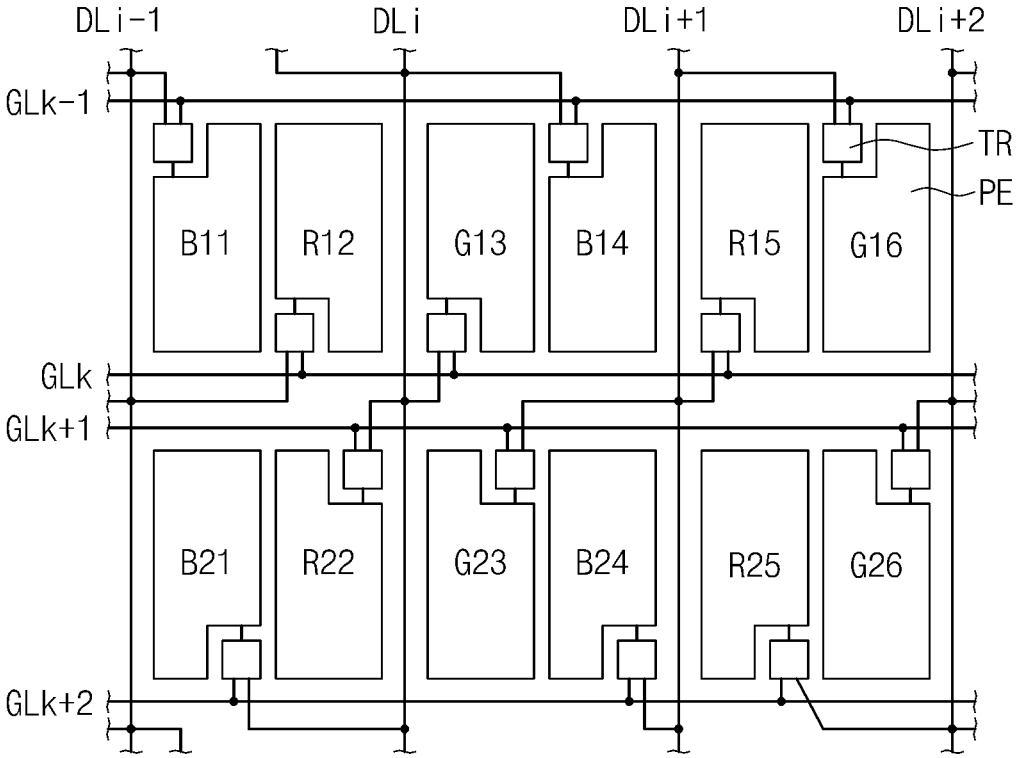
FIG. 4B is an enlarged plan view showing pixels arranged in a second display area of FIG. 3.

FIG. 4A is an enlarged plan view showing pixels arranged in a first display area of FIG. 3. FIG. 4B is an enlarged plan view showing pixels arranged in a second display area of FIG. 3.

Referring to FIG. 4A, six pixels are arranged in two rows and three columns. The six pixels shown in FIG. 4A may be repeatedly arranged in the first display area A1. Each of the six pixels includes two sub-pixels, and thus, the sub-pixels are arranged in two rows and six columns.

In each pixel, one sub-pixel is connected to the gate line positioned there above and the remaining sub-pixel is connected to the gate line positioned there below. In detail, a sub-pixel B11, which is located in a first row and a first column, is connected to a (j−1)th gate line GLj−1 positioned at the upper side of the sub-pixel B11. A sub-pixel R12 located in the first row and a second column is connected to a j-th gate line GLj positioned at the lower side of the sub-pixel R12.

In the present exemplary embodiment, the "B" of the "B11" represents the color displayed by the sub-pixel, and the "11" of the "B11" represents the location of the sub-pixel in the matrix. The sub-pixels R12, R15, R22, and R25, respectively located in a first row and a second column, a first row and a fifth column, a second row and a second column, and a second row and a fifth column, display a red color. The sub-pixels G13, G16, G23, and G26, respectively located at a first row and a third column, a first row and a sixth column, a second row and a third column, and a second row and a sixth column, display a green color. The sub-pixels B11, B14, B21, and B24, respectively located at a first row and a first column, a first row and a fourth column, a second row and a first column, and a second row and a fourth column, display a blue color.

In addition, the two sub-pixels in each pixel are connected to the same data line, e.g., the data line located at a left side of the pixel, or the data line located at a right side of the pixel. In other words, the pixels arranged in the same column are alternately connected to the data line at the left side thereof, or the data line at the right side thereof.

In detail, the sub-pixels B11, R12, G13, B14, R15, and G16 arranged in the first row are connected to the data line located at the right side of the sub-pixels, and the sub-pixels B21, R22, G23, B24, R25, and G26 arranged in the second row are connected to the data line located at the left side of the sub-pixels. That is, the sub-pixels B11 and R12 are connected to the i-th data line DLi positioned at the right side of the sub-pixels B11 and R12.

In each pixel, one sub-pixel is located adjacent to the data line to which the sub-pixels are connected, and the remaining sub-pixel is located adjacent to a data line to which the sub-pixels are not connected. Thus, the sub-pixels disposed adjacent to data lines to which the sub-pixels are not connected are affected by a signal transmitted through the data line. Particularly, since the sub-pixel B11 is disposed adjacent to the (i−1)th data line DLi−1, to which the sub-pixel B11 is not connected, the voltage applied to the sub-pixel B11 may be increased or decreased, according to the signal applied to the (i−1)th data line DLi−1.

When the above effect appears regularly, it may be apparent to users. Accordingly, the sub-pixels are irregularly connected to the gate lines and the data lines in FIG. 4A. For instance, the sub-pixel B11 and the sub-pixel G13 are connected to the (j−1)th gate line GLj−1 positioned at the upper side of the sub-pixels B11 and G13, while the sub-pixel R15 is connected to the j-th gate line GLj positioned at the lower side of the sub-pixel R15.

In other words, the (j−1)th gate line GLj−1 and the (j+1)th gate line GLj+1 correspond to the odd-numbered gate lines, and the j-th gate line GLj and the (j+2)th gate line GLj+2 correspond to the even-numbered gate lines. When the sub-pixels are divided into a first type of sub-pixel connected to the odd-numbered gate lines, and a second type of sub-pixel connected to the even-numbered gate lines, the sub-pixels B11, G13, G16, B21, G23, and G26 in FIG. 4A are the first type of sub-pixels, and the sub-pixels R12, B14, R15, R22, B24, and R25 in FIG. 4A are the second type of sub-pixels.

Referring to FIG. 4B, six pixels are arranged in two rows and three columns. The six pixels shown in FIG. 4B may be repeatedly arranged in the second display area A2. In addition, each of the six pixels includes two sub-pixels.

The two sub-pixels in each pixel are connected to the same data line, e.g., the data line located to the left side of the pixel, or the data line located to the right side of the pixel. In detail, the sub-pixels arranged in the first row are connected to the data lines at the left sides thereof, and the sub-pixels arranged in the second row are connected to the data lines at the right sides thereof. That is, the sub-pixel B11 and the sub-pixel R12 are connected to the data lines DLi.

The sub-pixels are irregularly connected to the gate lines and the data lines in FIG. 4B. For instance, the sub-pixel B11 is connected to the (k−1)th gate line GLk−1 disposed at the upper side of the sub-pixel B11, while the sub-pixel G13 and the sub-pixel R15 are connected to the k-th gate line GLk disposed at the lower side of the sub-pixels G13 and R15.

In other words, the (k−1)th gate line GLk−1 and the (k+1)th gate line GLk+1 correspond to the odd-numbered gate lines, and the k-th gate line GLk and the (k+2)th gate line GLk+2 correspond to the even-numbered gate lines. When the sub-pixels are divided into a first type of sub-pixel connected to the odd-numbered gate lines and a second type of sub-pixel connected to the even-numbered gate lines, the sub-pixels B11, B14, G16, R22, G23, and G26 in FIG. 4B are the first type of sub-pixel, and the sub-pixels R12, G13, R15, G21, B24, and R25 in FIG. 4B are the second type of sub-pixel.

Figure 5A:
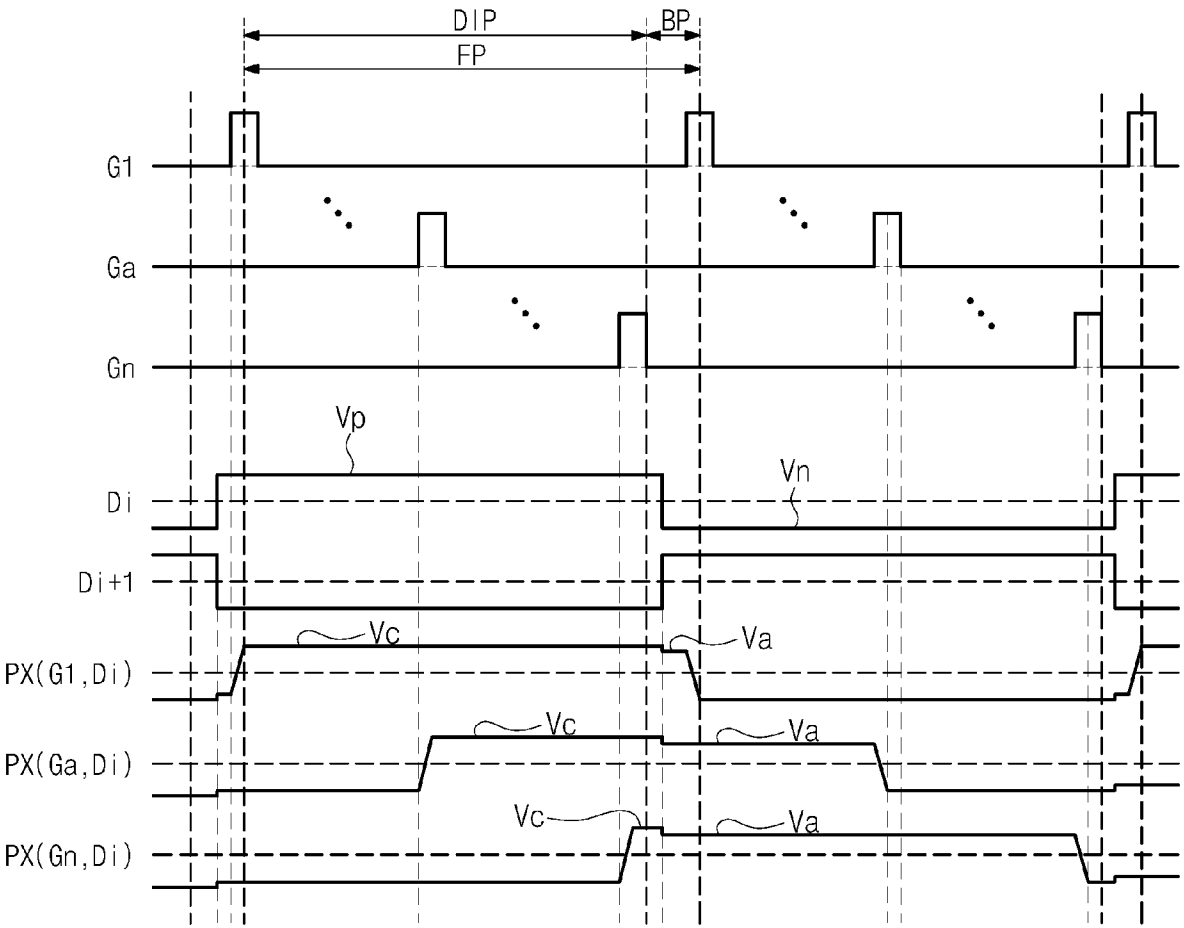
FIG. 5A is a timing diagram of signals applied to a display panel shown in FIG. 3, according to an exemplary embodiment of the present invention.
Figure 5B:
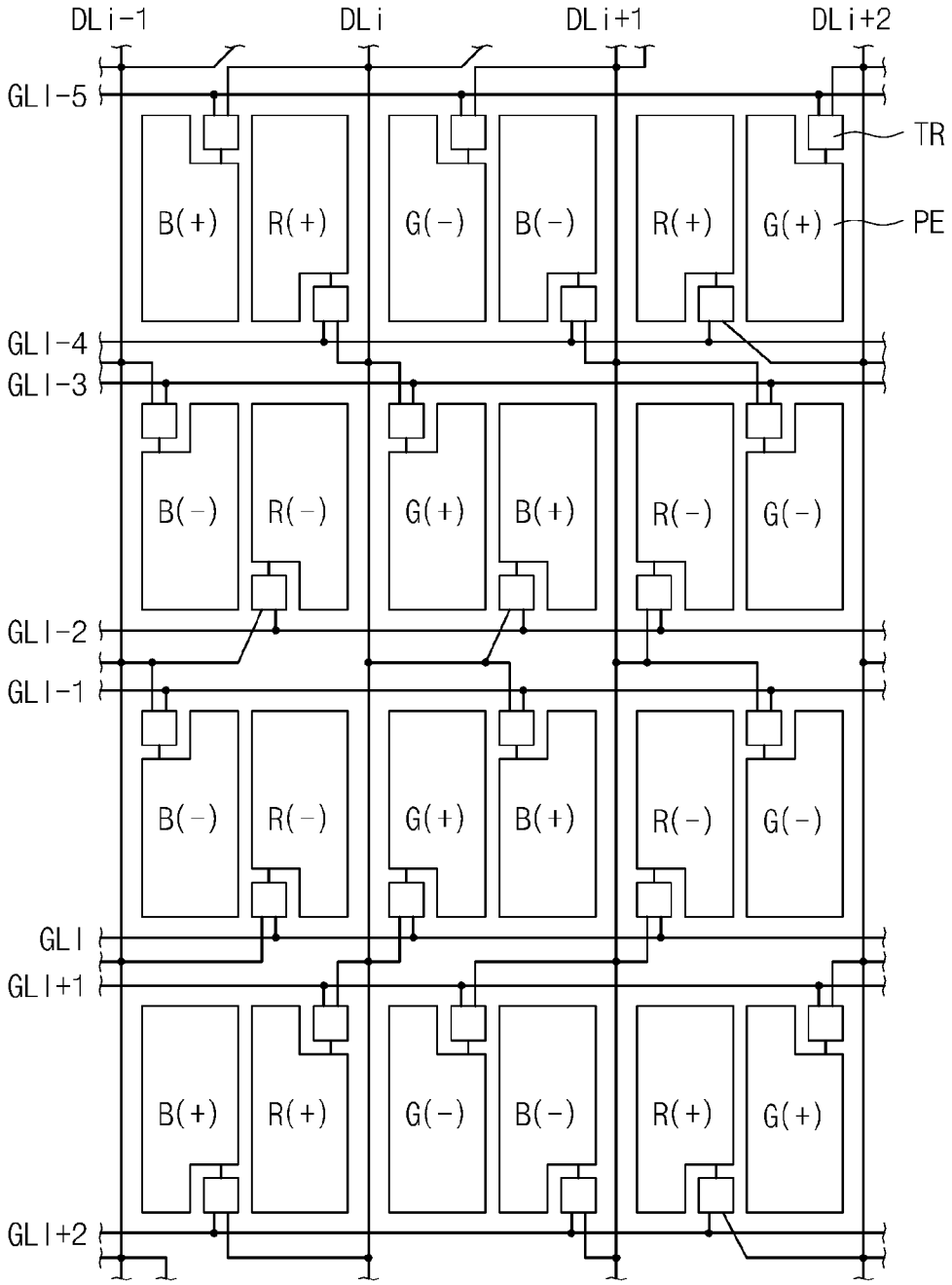
FIG. 5B is a plan view showing polarities of voltages applied to sub-pixels, when applying the signals shown in FIG. 5A.

FIG. 5A is a timing diagram of signals applied to the display panel shown in FIG. 3, according to an exemplary embodiment of the present invention. FIG. 5B is a plan view showing polarities of voltages applied to sub-pixels, when applying the signals shown in FIG. 5A.

Referring to FIG. 5A, the gate-on signal is sequentially applied to the first gate line GL1 to the n-th gate line GLn. That is, the high period is sequentially generated in the first gate signal G1 to the n-th gate signal Gn. An a-th gate signal Ga is a gate signal applied to a gate line located at a center of the display area DA.

Each of the data signals D1 to Dm is divided into a period during which the data voltage has a positive (+) polarity and a period during which the data voltage has a negative (−) polarity. That is, the polarity of the data voltage is inverted in subsequent frames. FIG. 5A shows only the polarity of the data voltage applied to the data line, and the level of the data voltage depends on the level of the voltage applied to each sub-pixel.

Two adjacent ones of the data lines DL1 to DLm are supplied with data voltages having opposite polarities. That is, the data voltages are applied to the data lines DL1 to DLm of the display panel 110 are column inversion signals.

In detail, the i-th data signal Di includes one frame time period during which the data voltage Vp having the positive (+) polarity is input, and a next frame time period during which the data voltage Vn having the negative (−) polarity is input. On the contrary, the (i+1)th data signal Di+1 includes one frame time period during which the data voltage Vn having the negative (−) polarity is input, and a next frame time period during which the data voltage Vp having the positive (+) polarity is input.

When the sub-pixel connected to the first gate line GL1 and the i-th data line DLi is referred to as a first pixel PX(G1, Di), the first pixel PX(G1, Di) is charged with a first voltage Vc during the high period of the first gate signal G1. However, since the polarity of the signal transmitted through the adjacent data line is inverted every frame, the polarity of the signal is affected. Thus, the voltage level of the first voltage Vc is changed to a voltage level of a second voltage Va, when the polarity of the signal transmitted through the adjacent data line is changed. In FIG. 5A, the second voltage Va has the voltage level that is lower than that of the first voltage Vc, but the second voltage Va may have the voltage level that is higher than that of the first voltage Vc.

When the sub-pixel connected to the a-th gate line GLa and the i-th data line DLi is referred to as a second pixel PX(Ga, Di), the second pixel PX(Ga, Di) is charged with the first voltage Vc during the high period of the a-th gate signal Ga. Similar to the first pixel PX(G1, Di), the voltage level of the first voltage Vc charged in the second pixel PX(Ga, Di) is changed to the voltage level of the second voltage Va, when the polarity of the signal transmitted through the adjacent data line is changed. The second pixel PX(Ga, Di) is maintained at the first voltage Vs during a shorter period than that of the first pixel PX(G1, Di).

When the sub-pixel connected to the n-th gate line GLn and the i-th data line DLi is referred to as a third pixel PX(Gn, Di), the third pixel PX(Gn, Di) is charged with the first voltage Vc during the high period of the n-th gate signal Gn. Similar to the first pixel PX(G1, Di) and the second pixel PX(Ga, Di), the voltage level of the first voltage Vc charged in the third pixel PX(Gn, Di) is changed to the voltage level of the second voltage Va, when the polarity of the signal transmitted through the adjacent data line is changed. The third pixel PX(Gn, Di) is maintained at the first voltage Vs during a shorter period than that of the first pixel PX(G1, Di) and the second pixel PX(Ga, Di).

The first voltage Vc refers to a voltage corresponding to a specific gray scale value. Thus, when the first voltage Vc is continuously applied to the first, second, and third pixels PX(G1, Di), PX(Ga, Di) and PX(Gn, Di), a specific gray scale value may be represented. As shown in FIG. 5A, however, since the voltage level of the first voltage Vc is changed to the voltage level of the second voltage Va, the specific gray scale value may not be represented.

According to the variation in voltage of the first, second, and third pixels PX(G1, Di), PX(Ga, Di) and PX(Gn, Di), the time period during which the first pixel PX(G1, Di) is maintained at the first voltage Vc is longer than that of the second and third pixels PX(Ga, Di) and PX(Gn, Di), so that the affection of the voltage level variation is reduced. However, the voltage level variation becomes larger form the pixels that are closer to the lower portion of the display area DA.

In detail, the voltage level of the first voltage Vc charged in the third pixel PX(Gn, Di) is changed to the voltage level of the second voltage Va, right after the third pixel PX(Gn, Di) is charged with the first voltage Vc. As a result, the third pixel PX(Gn, Di) may represent a gray scale value that is different from the specific gray scale value.

FIG. 5B shows twelve sub-pixels arranged in the first display area A1 and twelve sub-pixels arranged in the second display area A2. In other words, FIG. 5B shows twenty four sub-pixels adjacent to a boundary between the first and second display areas A1 and A2. In FIG. 5B, the top two rows of sub-pixels are arranged in the first display area A1, and the bottom two rows or sub-pixels are arranged in the second display area A2.

When the data voltage having the positive polarity is applied to the i-th data line DLi, and the data voltage having the negative polarity is applied to the (i+1)th data line DLi+1, the polarities of the voltages are as shown in FIG. 5B. In particular, the "(+)" and the "(−)" indicate the polarity of the voltage charged in the corresponding sub-pixels.

When the column inversion signals are applied to the data lines DL1 to DLm, the sub-pixels are driven by dot inversion, according to the pixels. As shown in FIG. 5B, however, the sub-pixels disposed on opposing sided of the boundary between the first and second display areas A1 and A2 are charged with the same polarity.

Figure 6A:
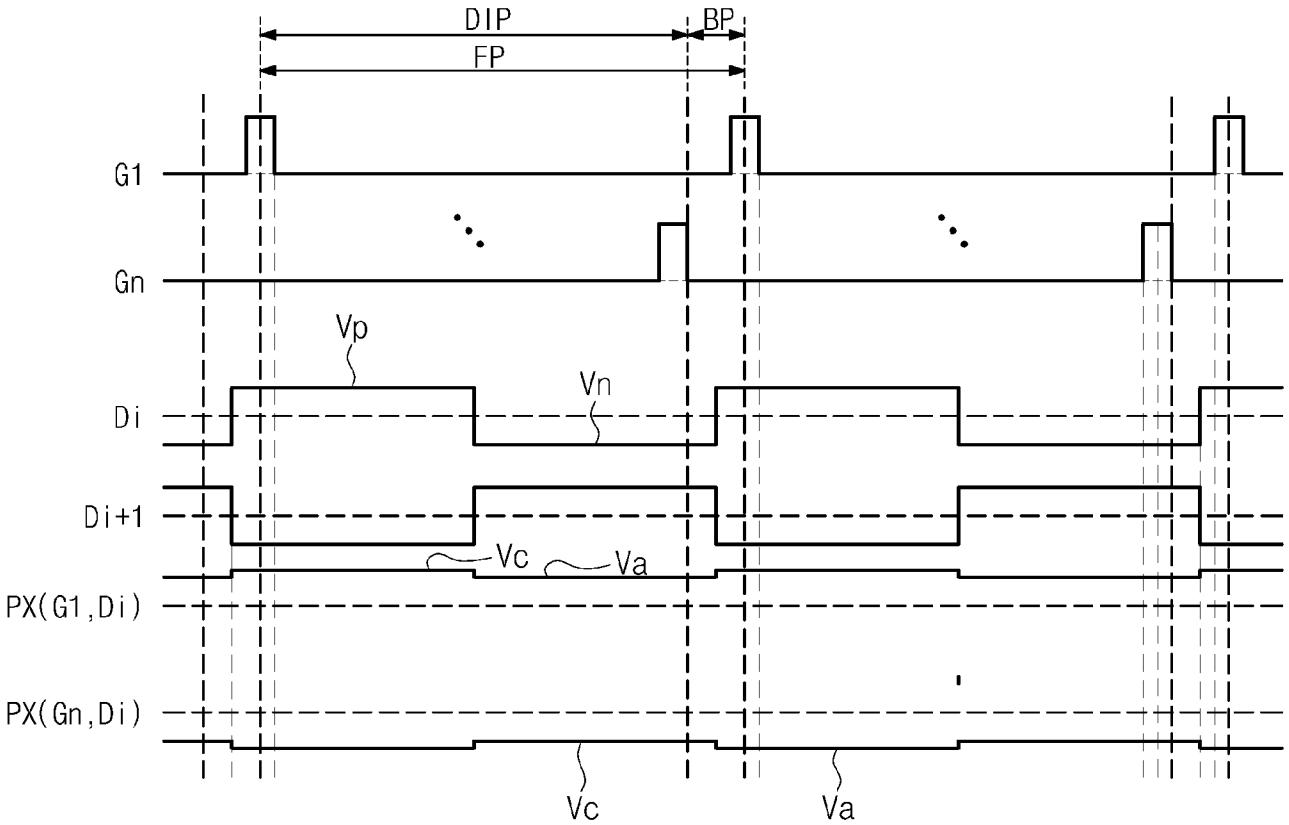
FIG. 6A is a timing diagram of signals applied to a display panel shown in FIG. 3, according to another exemplary embodiment of the present invention.
Figure 6B:
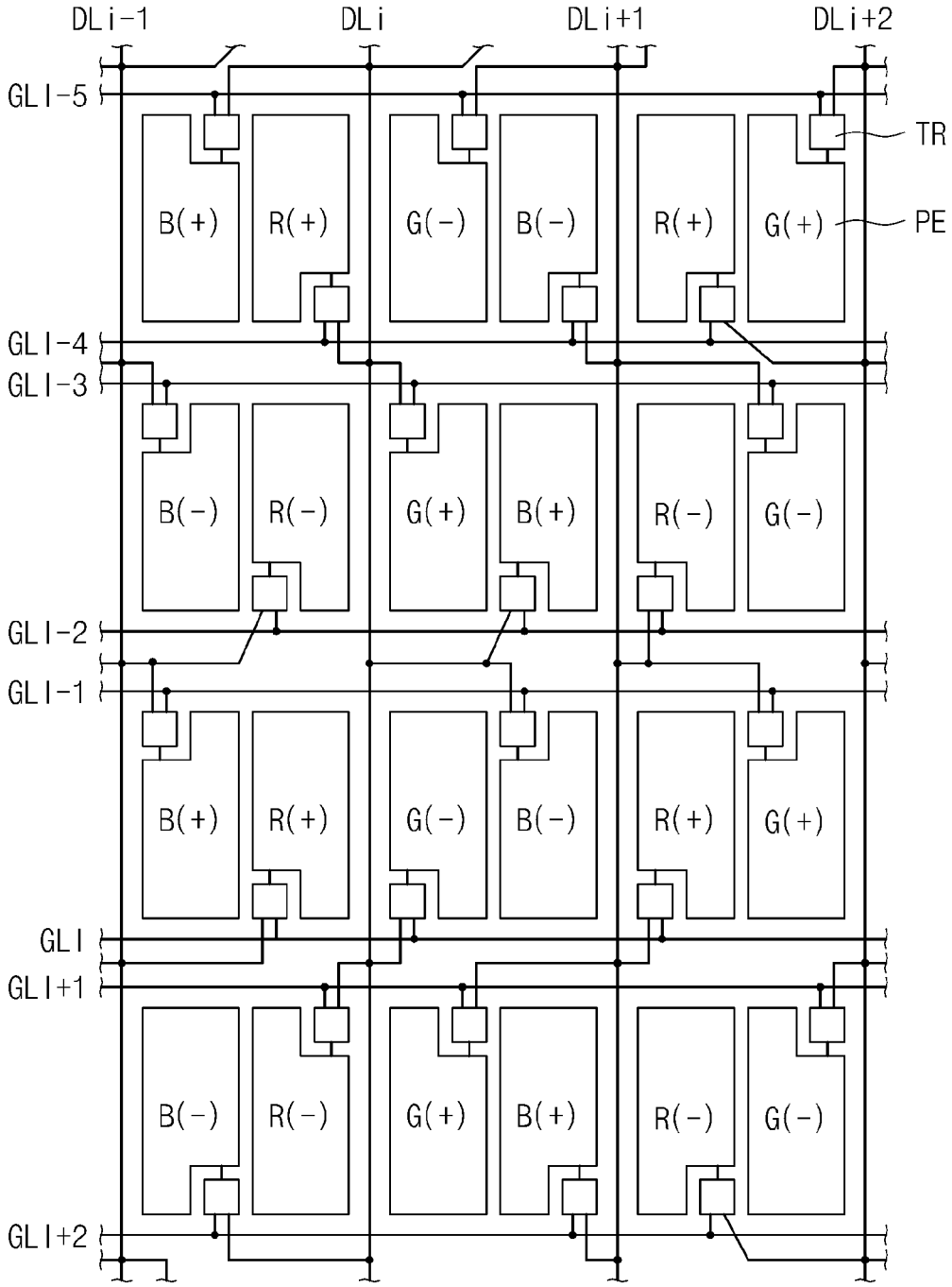
FIG. 6B is a plan view showing polarities of voltages applied to sub-pixels, when applying the signals shown in FIG. 6A.
Figure 6C:
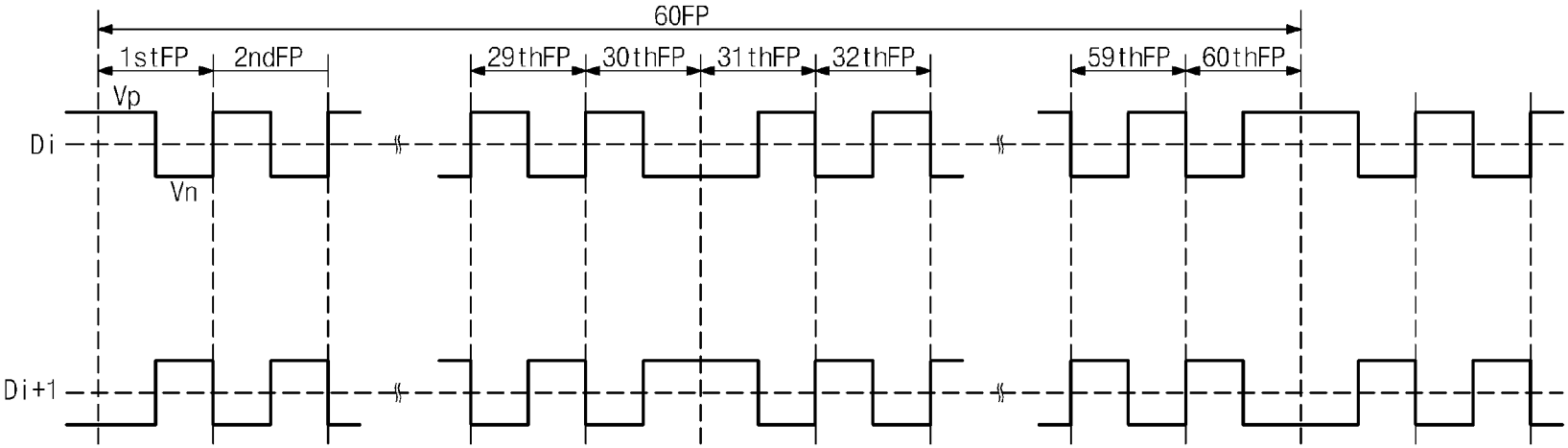
FIG. 6C is a timing diagram showing a polarity change of data signals of FIG. 6A.

FIG. 6A is a timing diagram of signals applied to the display panel shown in FIG. 3, according to another exemplary embodiment of the present invention. FIG. 6B is a plan view showing polarities of voltages applied to sub-pixels, when applying the signals shown in FIG. 6A. FIG. 6C is a timing diagram showing a polarity change of data signals of FIG. 6A.

Referring to FIG. 6A, each of the data signals D1 to Dm is divided into a period during which the data voltage Vp has a positive (+) polarity, and a period during which the data voltage Vn has a negative (−) polarity. That is, the polarity of the data voltage is inverted every ½ frame. FIG. 6A shows only the polarity of the data voltage applied to the data line, and the level of the data voltage depends on the level of the voltage applied to each sub-pixel. For convenience of explanation, the first and n-th gate lines GL1 and GLn and the sub-pixels PX(G1, Di) and PX(Gn, Di) are respectively connected to the first and n-th gate lines GL1 and GLn.

Two adjacent ones of the data lines DL1 to DLm are supplied with the data voltages having opposite polarities. That is, the data voltages applied to the data lines DL1 to DLm of the display panel 110 are column inversion signals.

A first pixel PX(G1, Di) is charged with a first voltage Vc during the high period of the first gate signal G1. However, since the polarity of the signal transmitted through the adjacent data line is inverted every ½ frame, the polarity of the signal is affected. Thus, the voltage level of the first voltage Vc is changed to a voltage level of a second voltage Va, when the polarity of the signal transmitted through the adjacent data line is changed.

A second pixel PX(Gn, Di) is charged with the first voltage Vc during the high period of the n-th gate signal Gn. Similar to the first pixel PX(G1, Di), the voltage level of the first voltage Vc charged in the second pixel PX(Gn, Di) is changed to the voltage level of the second voltage Va, when the polarity of the signal transmitted through the adjacent data line is changed.

According to the variation in the voltages of the first and second pixels PX(G1, Di) and PX(Gn, Di), the voltage level of the first voltage Vc charged in the first and second pixels PX(G1, Di) and PX(Gn, Di) is changed to the voltage level of the second voltage Va, when the polarity of the signal transmitted through the adjacent data line is changed. However, the time period during which the first pixel PX(G1, Di) is maintained at the first voltage Vc is similar to the time period during which the second pixel PX(Gn, Di) is maintained at the first voltage Vc.

In FIG. 6A, since the first voltage Vc corresponds to the specific gray scale value, the time period during which the pixels positioned at the upper portion of the display area DA are maintained at the first voltage Vc increases, and the time period during which the pixels positioned at the lower portion of the display area DA are maintained at the first voltage Vc decreases. Thus, the affect of the signal transmitted through the adjacent data line is uniform. Accordingly, it is difficult for a user to detect the variation of the gray scale values of the sub-pixels in the display area DA.

FIG. 6A shows the data signals having the positive polarity or the negative polarity, which are inverted once per frame (every ½ frame period). However, the data signals may have the positive polarity or the negative polarity, which are inverted every ½x (x is a constant number equal to or larger than 1) frame period. FIG. 6B shows twenty four sub-pixels adjacent to a boundary between the first and second display areas A1 and A2. As shown in FIG. 6B, the sub-pixels arranged in first and second rows are disposed in the first display area A1, and the sub-pixels arranged in third and fourth rows are disposed in the second display area A2.

The polarities of the voltages applied to the sub-pixels have been shown in FIG. 6B when the data voltage having the positive polarity is applied to the i-th data line DLi and the data voltage having the negative polarity is applied to the (i+1)th data line DLi+1. When the column inversion signals are applied to the data lines DL1 to DLm, the sub-pixels are driven by dot inversion by pixel. Different from FIG. 5B, the sub-pixels disposed on opposing sides of the boundary between the first and second display areas A1 and A2 are charged with the voltages having the different polarities. Accordingly, display characteristics may be improved at the boundary between the first and second display areas A1 and A2.

Referring to FIG. 6A again, the first pixel PX(G1, Di) is charged with the voltage having the positive polarity, and the second pixel PX(Gn, Di) is charged with the voltage having the negative polarity.

FIG. 6C shows the variation of the polarity of the i-th data signal Di and the (i+1)th data signal Di+1, during sixty frame periods. The positive voltage Vp and the negative voltage Vn are alternately applied to the i-th data signal Di and the (i+1)th data signal Di+1 every ½ frame, from a first frame 1stFP to a thirtieth frame 30thFP. Each of the i-th data signal Di and the (i+1)th data signal Di+1 may be maintained at the same polarity during successive ½ frame periods between the thirtieth frame 30thFP and the thirty first frame 31thFP.

Referring to FIGS. 6A and 6C, the positive data voltage Vp is applied to the first pixel PX(G1, Di) during the first half of each of frame periods 1 to 30, while the negative data voltage Vn is applied during the second half of each or the frame period 1-30. The opposite is true during the frame periods 31-60. The second pixel PX(Gn, Di) is supplied with data voltages opposite to that of the first pixel PX(G1, Di).

According to FIG. 6C, each sub-pixel may be prevented from being continuously supplied with the data voltage having the same polarity. However, the data voltage may be maintained at the same polarity for two successive ½ frame periods between every ten frames, every twenty frames, or every sixty frames.

Figure 7A:
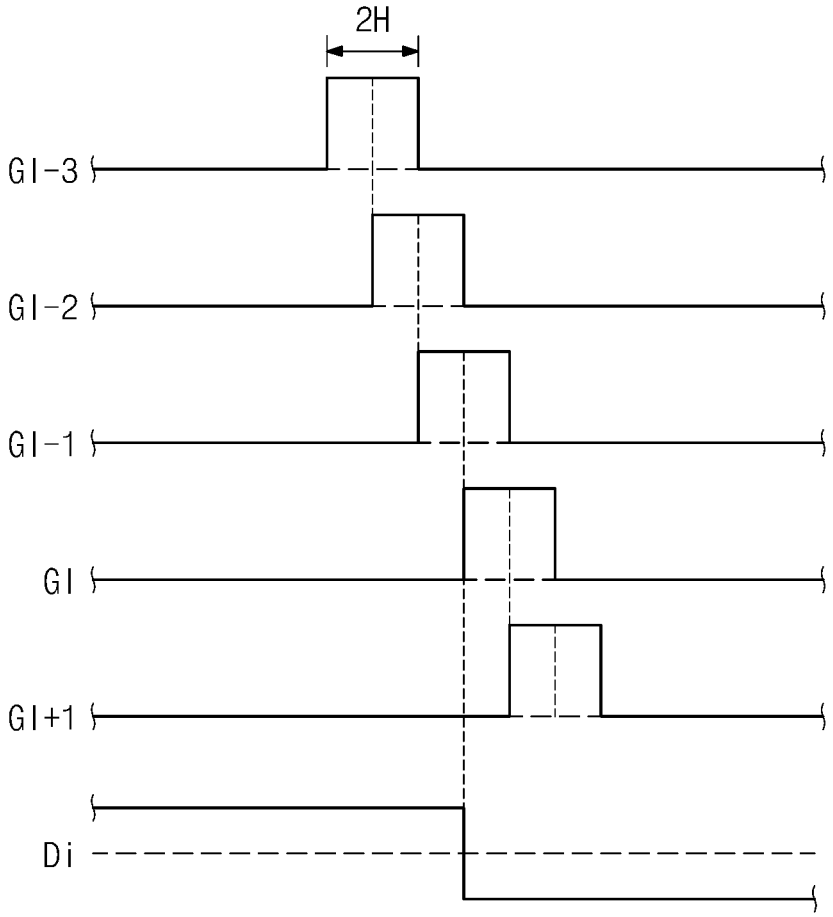
FIG. 7A is an enlarged timing diagram showing a position at which a polarity of a data signal is inverted.

FIG. 7A is an enlarged timing diagram showing positions at which the polarity of a data signal is inverted. In detail, FIG. 7A shows a (1−3)th gate signal G1−3 and a (1−2)th gate signal G1−2 that are applied to the pixels PX in the first display area A1, a (1−1)th gate signal G1−1, the first gate signal G1, and the (1+1)th gate signal G1+1 that are applied to the pixels PX in the second display area A2, and the variation of the polarity of the i-th data signal Di applied to the i-th data line DLi.

Referring to FIG. 7A, the (1−1)th gate signal G1−1 has the high period when the polarity of the i-th data signal Di is changed. In detail, the polarity of the i-th data signal Di is changed during the high period of the (1−1)th gate signal G1−1. That is, the i-th data signal Di has the positive polarity in the first 1 H time period of the (1−1)th gate signal G1−1, which is used for the precharge driving, and has the negative polarity in the second 1 H time period of the (1−1)th gate signal G1−1, during which the data voltage is input. Accordingly, the pixels supplied with the (1−1)th gate signal G1−1 are not precharged, so the pixels supplied with the (1−1)th gate signal G1−1 may not be supplied with a desired data voltage. Thus, the display panel as shown in FIG. 7B may be considered.

Figure 7B:
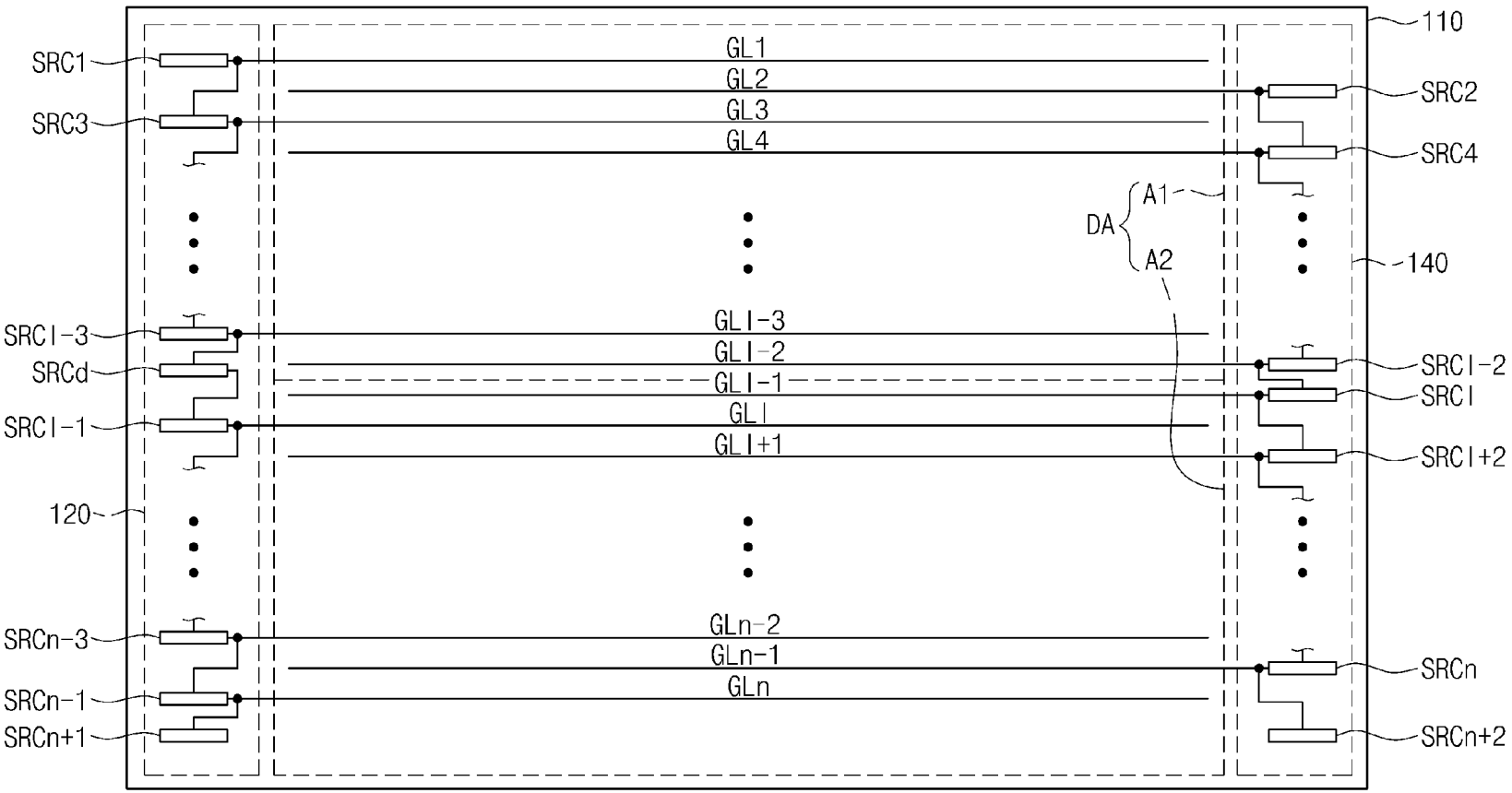
FIG. 7B is an enlarged plan view showing a display panel shown in FIG. 1, according to an exemplary embodiment.

FIG. 7B is an enlarged plan view showing a display panel shown in FIG. 1 according to an exemplary embodiment. For the convenience of explanation, the first and second gate drivers 120 and 140 and the first to n-th gate lines GL1 to GLn have been schematically shown in FIG. 7B.

Referring to FIG. 7B, the display panel 110 includes the first to n-th gate lines GL1 to GLn arranged in the column direction, and the first and second gate drivers 120 and 140 connected to the first to n-th gate lines GL1 to GLn. The first gate driver 120 includes the odd-numbered stages, such as the first stage SRC1, the third stage SRC3, the (n−1)th stage SRCn−1, etc., and the second gate driver 140 includes the even-numbered stages, such as the second stage SRC2, the fourth stage SRC4, the n-th stage SRCn, etc.

The first gate driver 120 further includes a dummy stage SRCd disposed between the (1−3)th stage SRCn−3 and the (1−1)th stage SRCn−1. The dummy stage SRCd delays the output timing of the gate-on signal, without being connected to the first to n-th gate lines GL1 to GLn.

Referring to FIG. 7B, the (1−1)th gate line GL1−1 is connected to the first stage SRC1 of the second gate driver 140, so as to delay the gate-on signal input to the (1−1)th gate line GL1−1. As such, the gate-on signal input to the (1−1)th gate line occurs after the 2 H time period of the gate-on signal input to the (1−2)th gate line GL1−2. In detail, the odd-numbered gate lines GL1, GL3, . . . , and GL1−3 in the first display area A1 are connected to the odd-numbered stages SRC1, SRC3, . . . , and SRC1−1, respectively. The even-numbered gate lines GL2, GL4, . . . , GL1−2 in the first display area A1 are connected to the even-numbered stages SRC2, SRC4, . . . , and SRC1−2. The odd-numbered gate lines GL1−1, GL1+1, . . . , and GLn−1 in the second display area A2 are respectively connected to the even-numbered stages SRC1, SRC1+2, . . . , and SRCn. The even-numbered gate lines GL1, GL1+2, . . . , GLn in the second display area A2 are respectively connected to the odd-numbered stages SRC1−1, . . . , SRCn−3, and SRCn−1.

FIG. 7B shows the configuration of the display panel, in order to delay the gate-on signal input to the (1−1)th gate line GL1−1 by the 2 H time period. However the configuration of the first and second gate drivers 120 and 140 may also be varied according to the delay time.

Figure 7C:
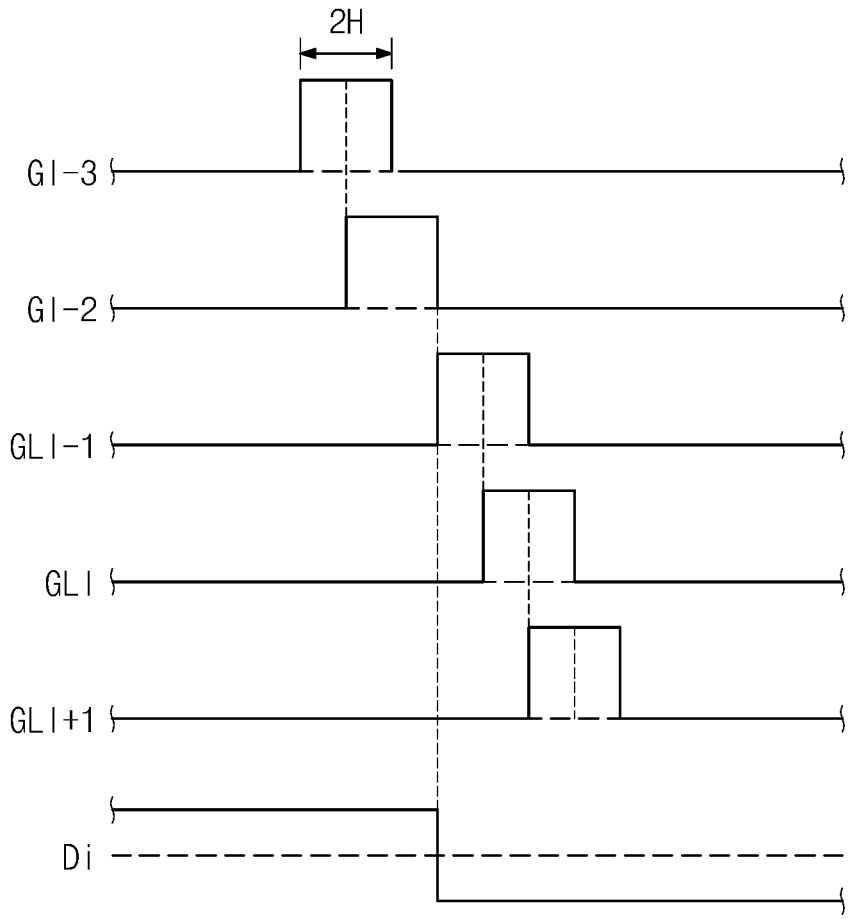
FIG. 7C is a timing diagram of signals applied to the display panel shown in FIG. 7B.

FIG. 7C is a timing diagram of signals applied to the display panel shown in FIG. 7B. In detail, FIG. 7C shows the timing of the signals corresponding to the signals shown in FIG. 7A. Referring to FIG. 7C, the high period of the (1−1)th gate signal G1−1 is delayed, such that is occurs after the 2 H time period of the high period of the 1-th gate signal G1. Thus, the high period of the (1−1)th gate signal G1−1 does not occur when the polarity of the i-th data signal Di is changed. As such, the pixels supplied with the (1−1)th gate signal G1−1 may be precharged like the other pixels and may receive the desired data voltage.

Figure 8:
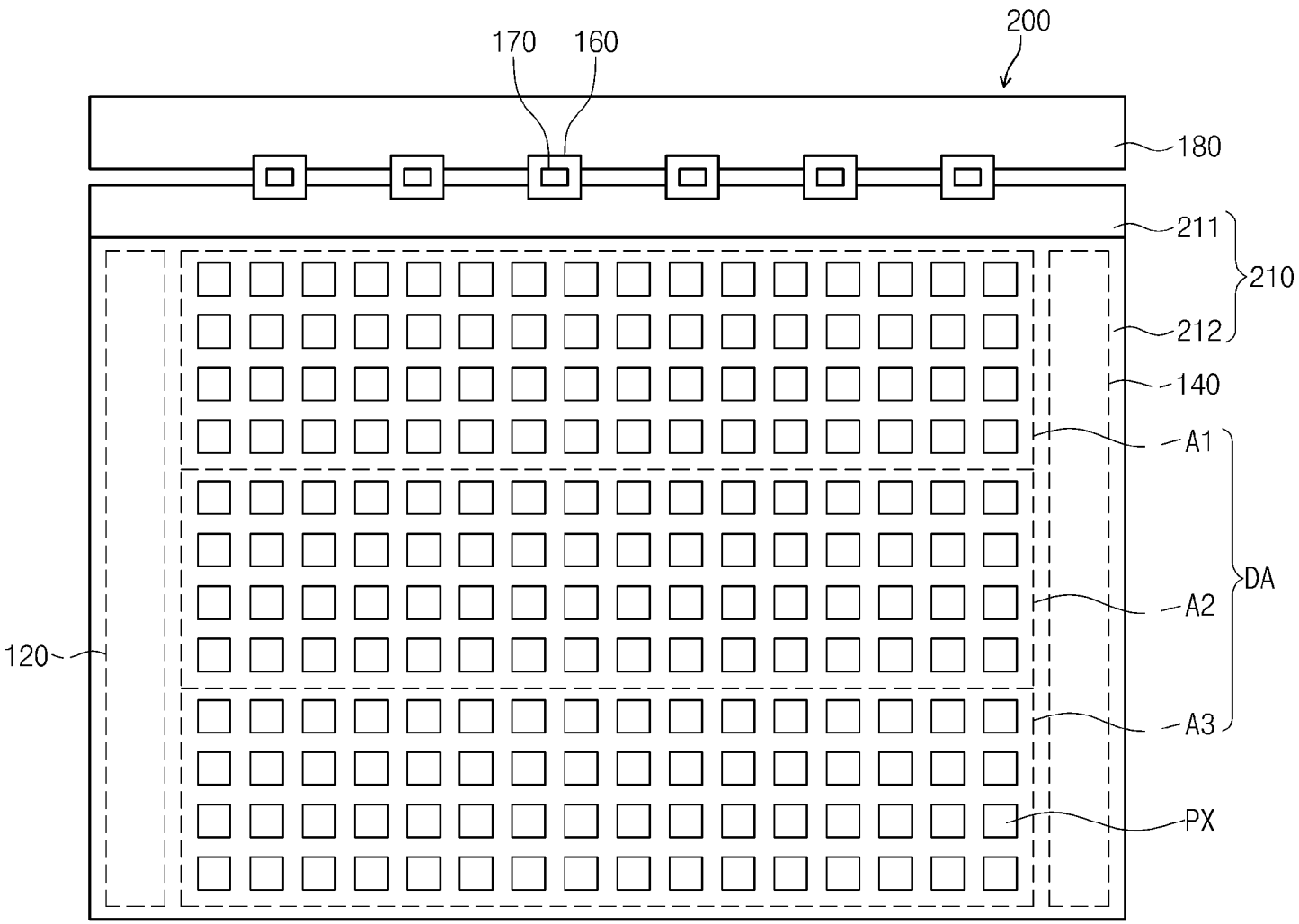
FIG. 8 is a plan view showing a display apparatus shown in FIG. 1, according to another exemplary embodiment of the present invention.

FIG. 8 is a plan view showing a display apparatus shown in FIG. 1, according to another exemplary embodiment of the present invention. In FIG. 8, the same reference numerals denote the same elements in FIG. 3, and thus, a detailed description of the same elements will be omitted.

Referring to FIG. 8, the display panel 210 may include a first substrate 211, a second substrate 212 facing the first substrate 211, and a liquid crystal layer (not shown) disposed between the first substrate 211 and the second substrate 212. The display panel 210 includes a plurality of pixels PX arranged in a display area DA thereof. FIG. 8 shows the pixels PX arranged in twelve rows and sixteen columns, as an example.

The display area DA is divided into a first display area A1 corresponding to an upper portion thereof, a second display area A2 corresponding to a center portion thereof, and a third display area A3 corresponding to a lower portion thereof. The arrangement of the pixels in the first and second display areas A1 and A2 will be described in detail, with reference to the following drawings.

Figure 9A:
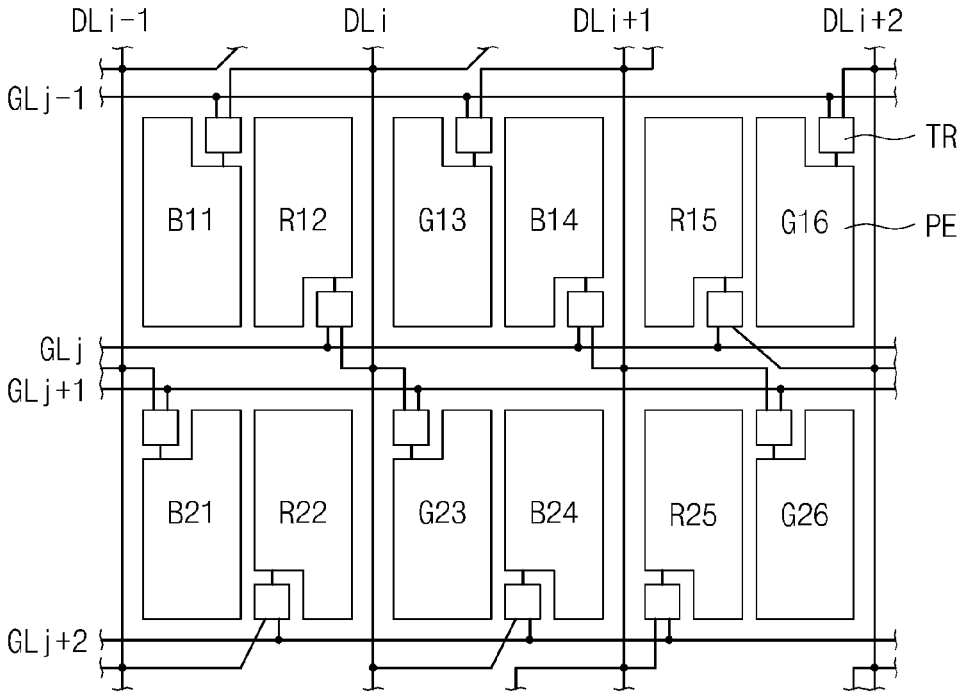
FIG. 9A is an enlarged plan view showing pixels arranged in first and third display areas shown in FIG. 8.
Figure 9B:
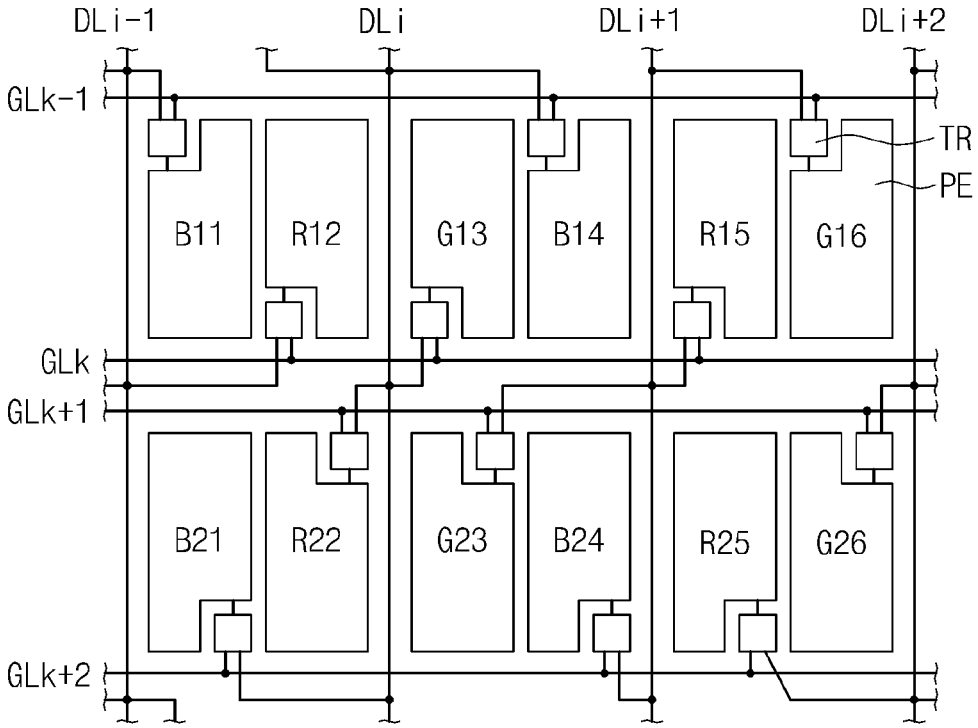
FIG. 9B is an enlarged plan view showing pixels arranged in second display area shown in FIG. 8.

FIG. 9A is an enlarged plan view showing the pixels arranged in the first and third display areas A1 and A3 shown in FIG. 8, and FIG. 9B is an enlarged plan view showing the pixels arranged in the second display area A2 shown in FIG. 8. The arrangements of the pixels in FIGS. 9A and 9B are the same as the arrangements of the pixels in FIGS. 4A and 4B.

Figure 10:
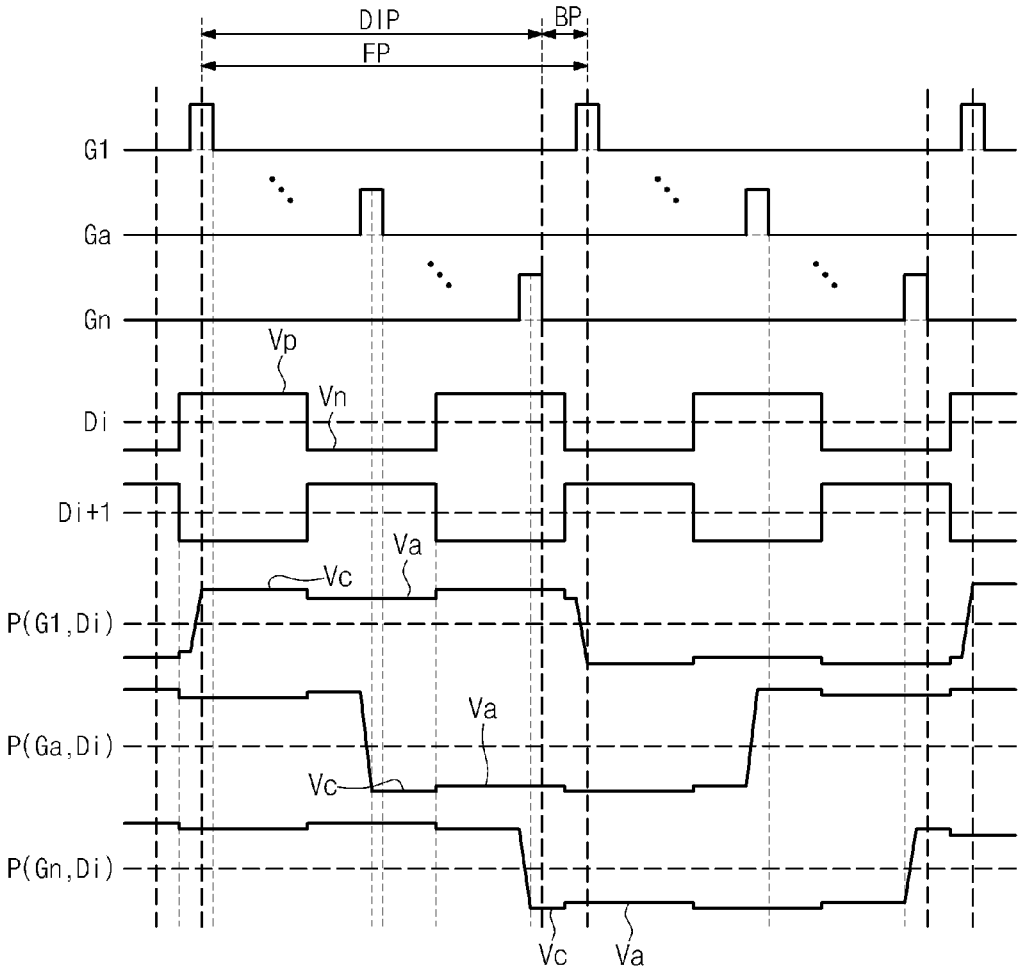
FIG. 10 is a timing diagram of signals applied to the display panel shown in FIG. 8.

FIG. 10 is a timing diagram of signals applied to the display panel shown in FIG. 8. Referring to FIG. 10, the gate-on signal is sequentially applied to the first gate line GL1 to the n-th gate line GLn. That is, the high period is sequentially generated at the first gate signal G1 to the n-th gate signal Gn. An a-th gate signal Ga is a gate signal applied to one of the gate lines arranged in the second display area A2.

Each of the data signals is divided into periods during which the data voltage has a positive (+) polarity and a negative (−) polarity. That is, the polarity of the data voltage is inverted every ⅓ frame. FIG. 10 shows only the polarity of the data voltages applied to the data lines, and the level of the data voltage depends on the level of the voltage applied to each sub-pixel.

Two adjacent ones of the data lines DL1 to DLm are supplied with the data voltages having opposite polarities. That is, the data voltages applied to the data lines DL1 to DLm of the display panel 110 are column inversion signals.

The first pixel PX(G1, Di) is charged with a first voltage Vc having the positive polarity during the high period of the first gate signal G1. However, since the polarity of the signal transmitted through the adjacent data line is inverted every ⅓ frame, the polarity of the signal is affected.

Thus, the voltage level of the first voltage Vc is changed to a voltage level of a second voltage Va, when the polarity of the signal transmitted through the adjacent data line is changed. After the ⅓ frame period, the voltage level of the second voltage Va is changed to the voltage level of the first voltage Vc, when the polarity of the signal transmitted through the adjacent data line is changed. Since the polarity of the signal transmitted through the adjacent data line is changed every ⅓ frame, the variation in the voltage charged in the first pixel PX(G1, Di) appears every ⅓ frame.

In FIG. 10, the second voltage Va has a voltage level that is lower than that of the first voltage Vc, but the second voltage Va may have a voltage level that is higher than that of the first voltage Vc. The second pixel PX(Ga, Di) is charged with the first voltage Vc having the negative polarity during the high period of the a-th gate signal Ga. Similar to the first pixel PX(G1, Di), the voltage level of the first voltage Vc charged in the second pixel PX(Ga, Di) is changed to the voltage level of the second voltage Va every ⅓ frame, when the polarity of the signal transmitted through the adjacent data line is changed.

The third pixel PX(Gn, Di) is charged with the first voltage Vc having the positive polarity during the high period of the n-th gate signal Gn. Similar to the first pixel PX(G1, Di) and the second pixel PX(Ga, Di), the voltage level of the first voltage Vc is changed to the voltage level of the second voltage Va every ⅓ frame, when the polarity of the signal transmitted through the adjacent data line is changed.

According to the variation in voltage of the first, second, and third pixels PX(G1, Di), PX(Ga, Di) and PX(Gn, Di), the voltage level of the first voltage Vc charged in the first, second, and third pixels PX(G1, Di), PX(Ga, Di), and PX(Gn, Di) is changed to the voltage level of the second voltage Va, when the polarity of the signal transmitted through the adjacent data line is changed. However, the time period during which the first, second, and third pixels PX(G1, Di), PX(Ga, Di), and PX(Gn, Di) are maintained at the first voltage Vc is substantially the same as the time period during which the first, second, and third pixels PX(G1, Di), PX(Ga, Di), and PX(Gn, Di) are maintained at the second voltage Va. Thus, it is difficult for a user to recognize the gray level variations.

In FIGS. 3 and 8, the display area DA is divided into two or three display areas. However, the display area DA may be divided into y areas (y is a constant number equal to or larger than 2).

When the display area DA is divided into y display areas in the column direction, two adjacent pixels arranged in the same column and disposed in different display areas are connected to the same data line. In addition, the pixels arranged in each display area have been described to have different configurations, however, the pixels arranged in each display area may have the same configuration. When the display area DA is divided into the y display areas, the data lines DL1 to DLm may be supplied with the data voltages having polarities that are inverted every 1/y frame time period.

Although not shown in FIGS. 8 and 10, the first and second gate drivers 120 and 140 may include at least one dummy stage, so as to delay the output of the gate-on signal. Thus, the gate signal does not have the high period at the time point when the polarity of the data signal is changed.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A display apparatus comprising:

a substrate comprising a first display area and a second display area;

gate lines disposed on the substrate;

data lines extending in a column direction and across the gate lines; and pixels arranged in a matrix of rows and columns and disposed between the gate lines and the data lines, wherein:

the data-lines are disposed between each of pixel pairs, each pixel pair comprising a first sub-pixel and a second sub-pixel;

in the first display area, the first and second sub-pixels of each pixel pair arranged in an odd-numbered row are connected in common to an adjacent right-side data line, and the first and second sub-pixels of each pixel pair arranged in an even-numbered row are connected in common to an adjacent left-side data line; and in the second display area, the first and second sub-pixels of each pixel pair arranged in an odd-numbered row are connected in common to an adjacent left-side data line, and the first and second sub-pixels of each pixel pair arranged in an even-numbered row are connected in common to an adjacent right-side data line.

2. The display apparatus of claim 1, further comprising a data driver configured to supply the data lines with a data voltage having a polarity that is inverted at least once during each frame period of an image displayed by the display apparatus, with reference to a reference voltage.

3. The display apparatus of claim 2, wherein the data driver is configured to supply two adjacent data lines with data voltages having different polarities from each other.

4. The display apparatus of claim 1, wherein:

the first display area comprises first pixel groups and the second display area comprises second pixel;

the first pixel groups and the second pixel groups each comprise six pixel pairs arranged in two rows and three columns; and the pixel pairs each comprise the first sub-pixel connected to a corresponding one of first gate lines of the gate lines, and the second sub-pixel connected to a corresponding one of second gate lines of the gate lines.

5. The display apparatus of claim 4, wherein in each row of the first pixel groups only two of the first sub-pixels are disposed directly adjacent to one another.

6. The display apparatus of claim 5, wherein in each of the second pixel groups:

in a first one of the rows, only two of the second sub-pixels are disposed directly adjacent to one another; and in a second one of rows, only two of the first sub-pixels are disposed directly adjacent to one another and only two of the second sub-pixels are disposed directly adjacent to one another.

7. The display apparatus of claim 6, wherein:

in each of the first pixel groups the directly adjacent first sub-pixels of a first one of the rows are disposed directly adjacent to the directly adjacent first sub-pixels of a second one of the rows, in a column direction; and in each of the second sub-pixel groups, the directly adjacent second sub-pixels of the first row are disposed directly adjacent to the directly adjacent first sub-pixels of the second row, in a column direction.

8. The display apparatus of claim 4, wherein the data driver is configured to supply each of the data lines with a data voltage having a polarity that is inverted at least twice during each frame period of an image displayed by the display apparatus.

9. The display apparatus of claim 8, wherein each of the data voltages is maintained at a constant polarity during at least one frame period every two or more frame periods.

10. The display apparatus of claim 8, wherein the display apparatus comprises three of the display areas.

11. The display apparatus of claim 10, wherein in each of the second pixel groups:

the first sub-pixels are located at a first row and a first column, the first row and a fourth column, the first row and a sixth column, a second row and a second column, the second row and a third column, and the second row and the sixth column; and the second sub-pixels are located at the first row and the second column, the first row and the third column, the first row and the fifth column, the second row and the first column, the second row and the fourth column, and the second row and the fifth column.

12. The display apparatus of claim 1, wherein the first and second sub-pixels each emit red, green, or blue light.

13. The display apparatus of claim 1, wherein:

the substrate further comprises a third display area, the second display area being disposed between the first display area and the third display area; and in the third display area, the first and second sub-pixels of each of odd-numbered pixel pairs arranged in the column direction are connected in common to a right-side data line adjacent to each odd-numbered pixel pair, and the first and second sub-pixels of each of even-numbered pixel pairs arranged in the column direction are connected in common to a left-side data line adjacent to each even-numbered pixel pair.

14. The display apparatus of claim 13, wherein the data driver is configured to supply each of the data lines with a data voltage having a polarity that is inverted twice during each frame period of an image displayed on the display apparatus.

15. The display apparatus of claim 1, wherein:

the gate lines comprise first gate lines and second gate lines, and the display apparatus further comprising:

a first gate driver to output gate signals to the first gate lines;

a second gate driver to output gate signals to the second gate lines; and a timing controller to output gate control signals to the first and second gate drivers and to output an image signal and a data control signal to the data driver.

16. The display apparatus of claim 2, further comprising a gate driver comprising:

stages to apply gate-on signals to the gate lines; and a dummy stage disposed between two of the stages to delay an output timing of the gate-on signals.

17. The display apparatus of claim 16, wherein the stages sequentially output the gate-on signals, such that only two consecutive gate-on signals are at least partially overlapped.

* * * * *